United States Patent [19]

Kobayashi et al.

[11] 4,125,133

[45] Nov. 14, 1978

[54] AIR JET LOOM WITH IMPROVED AIR GUIDING COMB

[75] Inventors: Yasushi Kobayashi, Kokubunji; Akira Ito, Hanno, both of Japan

[73] Assignee: Nissan Motor Company, Limited, Japan

[21] Appl. No.: 830,344

[22] Filed: Sep. 2, 1977

[30] Foreign Application Priority Data

Sep. 3, 1976 [JP] Japan ..... 51-104981

[51] Int. Cl.[2] ..... D03D 47/29

[52] U.S. Cl. ..... 139/435

[58] Field of Search ..... 139/435; 226/95

[56] References Cited

U.S. PATENT DOCUMENTS 3,847,187 11/1974 Buran et al. ..... 139/435

*Primary Examiner*—Henry S. Jaudon

*Attorney, Agent, or Firm*—Robert E. Burns; Emmanuel J. Lobato; Bruce L. Adams

[57] ABSTRACT

To facilitate high speed weaving, the size of all or some of the openings formed in a plurality of air guide comb teeth may be stepwisely increased, decreased or increased and then decreased and/or the angle of inclination of the frusto-conical surfaces which define the openings may be decreased in the case where the openings are decreased in size and vice versa.

11 Claims, 9 Drawing Figures

AIR JET LOOM WITH IMPROVED AIR GUIDING COMB

BACKGROUND OF THE INVENTION

The present invention relates in general to an air jet loom and more particularly to an air guiding comb, composed of a row of aligned tooth members, which is used for directing the air stream which transports the weft yarn through the shed of warp yarns.

SUMMARY OF THE INVENTION

It is another object of the present invention to provide an air jet loom the weaving performance of which permits increased weaving speed.

It is another object of the present invention to provide an air jet loom which can substantially eliminate an undesirable phenomenon in which the weft yarn is entangled with the warp yarns during the weft yarn insertion or picking into the shed of warp yarns.

According to the present invention, there is provided an air guide comb for an air jet loom having an air jet nole through which a pressuried air is passed out with a weft yarn, and a row of aligned air guiding tooth members arranged in a manner that openings formed in the respective tooth members form an air passage through which the weft yarn is passed by the aid of the pressuried air, each of the openings being bounded by a frusto-conical surface of the corresponding tooth member with an apex of the surface pointing in the direction of weft yarn picking, which is characteried in that the row of aligned air guiding tooth members has at least first and second adjacent tooth members having respective openings which form a part of the air passage and are stepwisely different in sectional area and further in that the inclination angles of the frusto-conical surfaces defining the openings of the first and second tooth members, with respect to the longitudinal center line of the air passage, are different from each other.

DESCRIPTION OF THE PREFERRED DRAWINGS

Other objects and advantages of the present invention will become apparent from the following detailed description when taken in conjunction with the accompanying drawings, in which.

DESCRIPTION OF THE PREFERRED EMBODIMENTS

In order to clarify the inventive steps of the present invention, a description of the construction of the conventional air guiding comb will be given with aid of the FIGS. 1 and 2. As is known, the guiding comb is a member to guide the air jetted from an air jet nole to form an air stream therein transporting the weft yarn through and out of the comb prior to the beat up of the reed.

Figure 1:
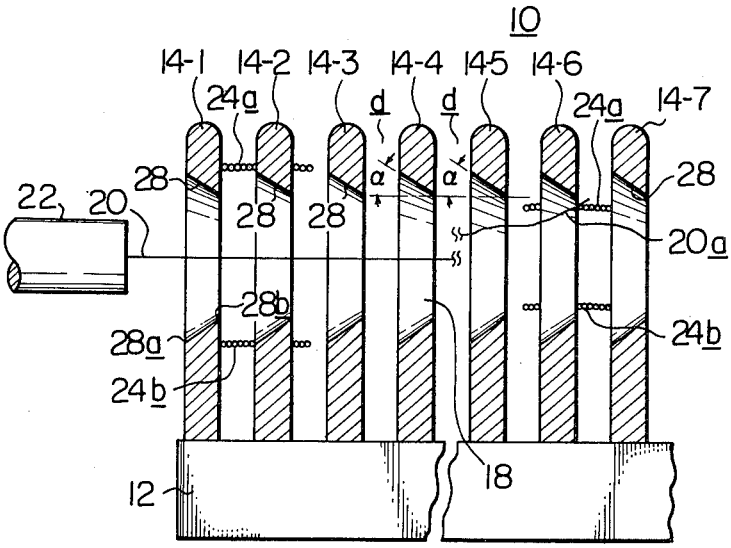
Fig. 1 PRIOR ART
FIG. 1 is a partial, sectional side elevation view of a conventional air guiding comb.
Figure 2:
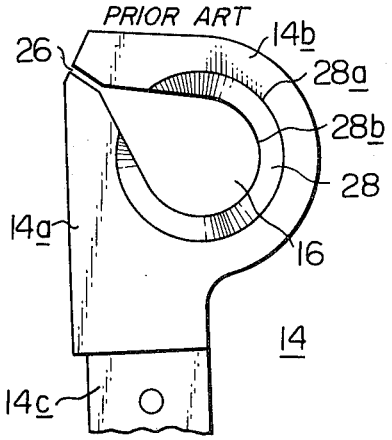
Fig. 2 PRIOR ART
FIG. 2 is a view, in elevation, of a tooth member employed in the conventional air guiding comb of FIG. 1.

Referring to FIG. 1, there is illustrated a conventional air guiding comb as generally designated by numeral 10. The comb 10 shown comprises an elongate base member 12, and a number of tooth members 14 fixed at their lower or stem portions to the elongate base member 12 so as to be spaced by substantially equal distances, *d*. As well seen in FIG. 2, each of the tooth members 14 includes a straight portion 14*a*, an arcuate portion 14*b* which form an opening 16, and a stem portion 14*c* which is adapted to be fixed to the elongate base member 12. As will be well understood from FIG. 1, the openings 16 of the tooth members 14 form an air passage 18 when aligned through which a weft yarn 20 ejected from an air jet nole 22 passes during insertion or picking thereof into the shed of warp yarns 24. Indicated by numeral 26 in FIG. 2 is a gap which is formed between the leading ends of the straight and arcuate portions 14*a* and 14*b* to allow the inserted weft yarn 20 in the air passage 18 to pass out therethrough at the time the comb 10 is moved out of the shed.

In the known air guiding comb 10 mentioned above, it is usual to provide the openings 16 of the tooth members 14 with substantially identical frusto-conical surfaces 28, with the imaginary apexes thereof pointing in the direction of weft yarn picking, in order to concentrate the air stream in the center of the air passage 18 of the comb 10 and to reduce to a minimum the losses of energy of the air stream passing from one tooth member to the next. For facilitation of the following explanation, an upstream end and a downstream end of the frusto-conical surface of each tooth member 14 will be denoted by numerals 28*a* and 28*b*, respectively.

Upon operation of the conventional air jet loom equipped with the above-mentioned air-guiding comb 10, however, it frequently occurs that the weft yarn insertion into the air passage 18 formed in the comb 10 is not smoothly made especially during high speed weaving. This is because of the reduction of energy of the air stream transporting the weft yarn 20. More specifically, under such high speed weaving, time available for ejecting the air and picking of the weft yarn becomes very short hence reducing the amount of air jettable per pick. There is a limitation in increasing the amount of the jetted air, since the velocity of the air has an upper limit at the sonic level. Furthermore, it is impossible to provide the air jet nole with a large diameter bore because, with this, the weft yarn conveying ability of the air stream is markedly reduced. These limitations sometimes cause that a leading end 20*a* of the weft yarn 20 contacts the frusto-conical surfaces of the tooth members positioned at a downstream portion of the comb 10 during high speed weaving. This means the failure of the weft yarn to be properly picked through the air passage 18.

In the known air jet loom, it is also usual that in order to reduce to a minimum the losses of energy of the air stream flowing through the air passage 18, the comb 10 is controlled to move in a position to locate upper and lower groups 24*a* and 24*b* of the warp yarns 24 at respective positions slightly above and below the openings 16 of the tooth members 14 thereby partially enclosing the air passage 18. However if the weaving speed becomes quite high, the closing movement of the upper and lower groups 24*a* and 24*b* of the warp yarns 24 occurs before the weft yarn insertion or picking is completed, so that the leading end 20*a* of the weft yarn 20 will be entangled with some of the warp yarns 24 positioned relatively near the outlet end of the air passage 18 as shown in FIG. 1.

In view of the above, several experiments have been made by the inventors and the following two criteria have been established, which are:

First, if the sectional areas of the openings of the tooth members are gradually or stepwisely increased with increase of distance from the air jet nole so that the air jet, which is steadily increasing, does not encounter an opening which is smaller in cross sectional area than itself, the loss of energy of the air stream flowing along the central passage of the air passage 18 is reduced to a minimum. In fact, by employing such an arrangement, the reduction of the velocity of the air stream was found to be small in comparison with the case of FIG. 1. Furthermore, if the inclination angles, designated by reference marks $\alpha$ in FIG. 1, of the frusto-conical surfaces of the opening of the tooth members 14 with respect to the longitudinal center line of the air passage 18 are gradually or stepwisely increased with increase of distance from the air jet nole 22, the loss of energy of the air stream in the air passage 18 is even more effectively reduced.

Second, if the tooth members are arranged to have openings which are so sied that as the leading end of the weft yarn passes through each of the tooth members, the corresponding warp yarns are still located above and below the periphery of the opening formed therein, then it is impossible for the weft yarn to become entangles with any of the warp yarns. If desired, this formation may be applied to only the tooth members which are positioned at the downstream portion of the comb 10, that is a portion near the outlet of the air passage 18. Further, if the inclination angles of the frusto-conical surfaces of these tooth members are stepwisely or gradually reduced with increase of distance from air jet nole 22, the flow resistance present by these tooth members against the air stream in the air passage 18 is lowered with a result that the weft yarn insertion into the air passage 18 is more reliably achieved. Although, in this case, the diffusion of the air out of the air passage 18 may be greater than the case of the first way, the velocity of the air stream flowing through the air passage 18 is not so greately decreased in comparison with the first case.

The present invention is thus accomplished by taking the above-mentioned first and second criteria into consideration.

Figure 3:
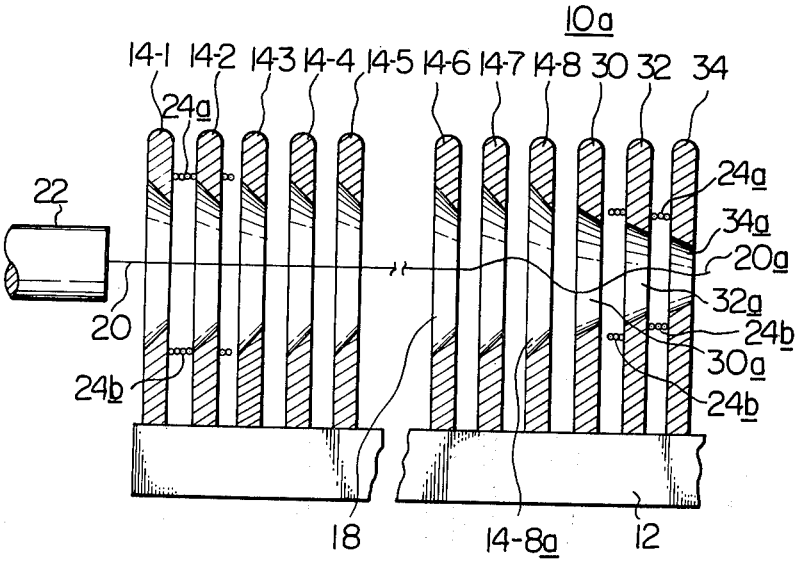
FIG. 3 is a sectional side elevation view of a first preferred embodiment, of an air guiding comb, according to the present invention.
Figure 4:
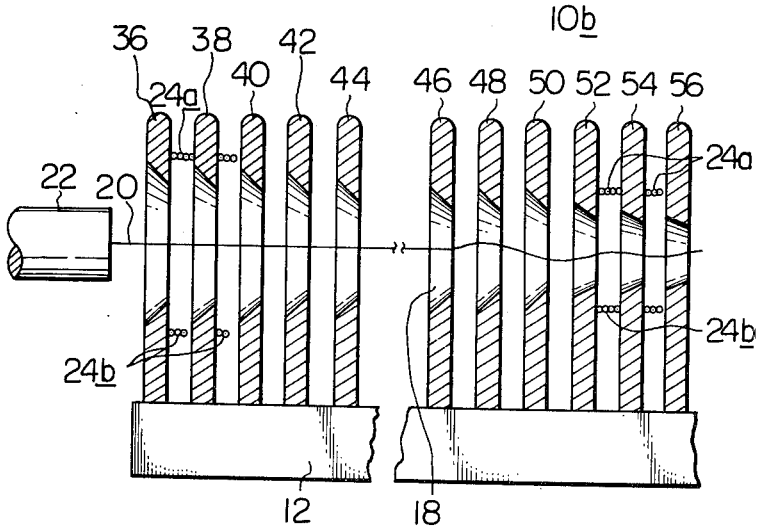
FIG. 4 to 9 are views similar to FIG. 3, but showing other preferred embodiments of the present invention, respectively.
Figure 5:
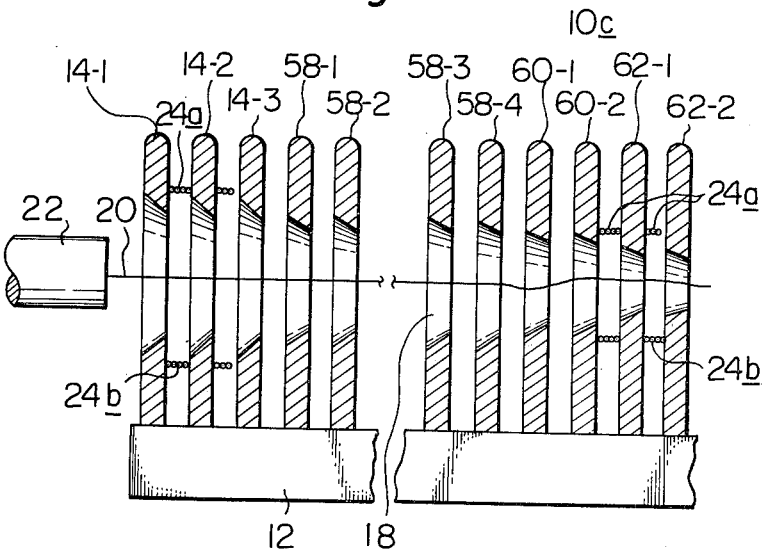
Figure 6:
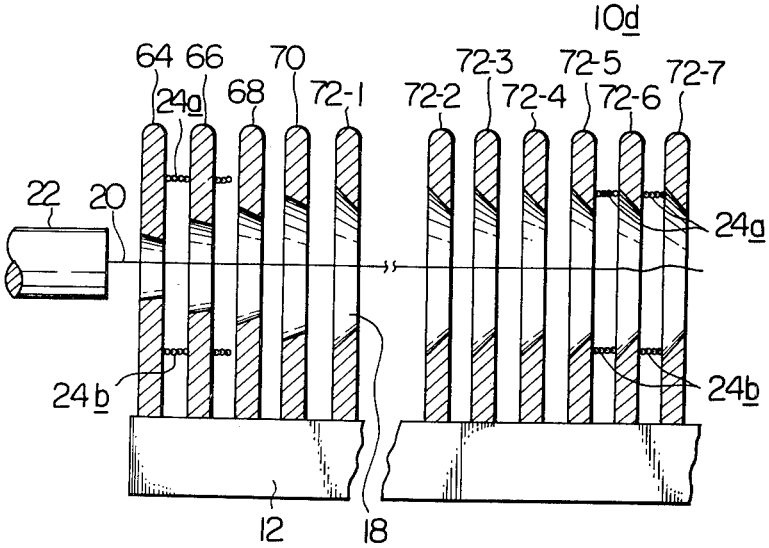
Figure 7:
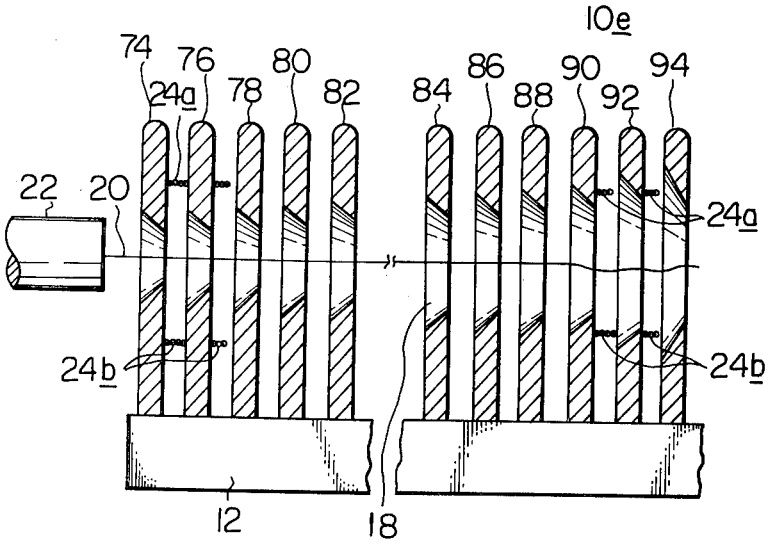
Figure 8:
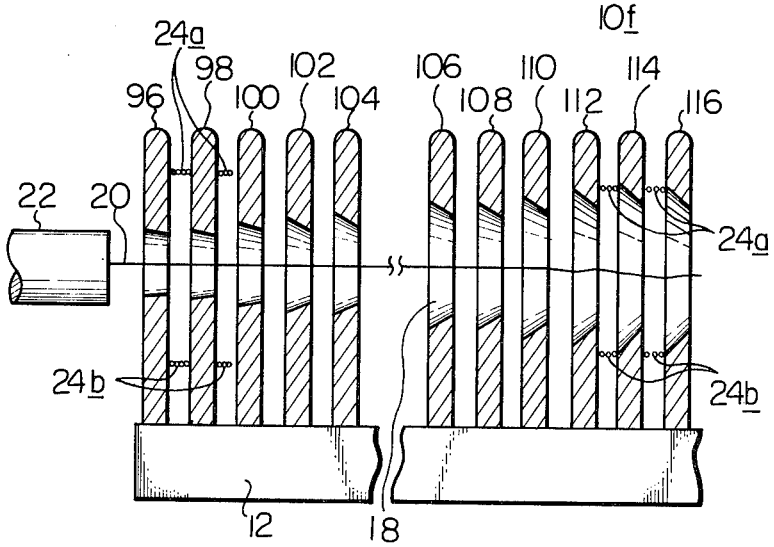
Figure 9:
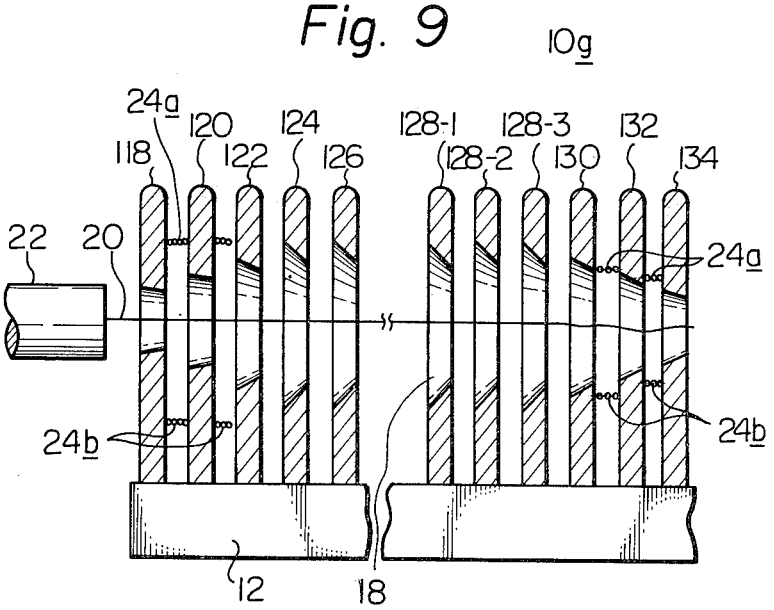

Referring to FIGS. 3 to 9 of the drawings, there are illustrated seven embodiments according to the present invention. In these figures, the embodiments shown in FIGS. 3 to 5 are based on the second criterion, the embodiments in FIGS. 6 to 8 are based on the first criterion and the embodiment of FIG. 9 is made by combining these first and second criteria. It should be noted that each of the drawings (FIGS. 3 to 9) shows at its left side a state where the weft yarn 20 has just been jetted from the air jet nole 22 and at its right side a state where the weft yarn 20 has just been passed out of the air passage 18. In the following description, similar parts to those of the above-mentioned conventional air guiding comb 10 are designated by the same numerals as the comb 10.

In FIG. 3, the first embodiment of the present invention is shown as being designated by a reference numeral 10*a*. The comb 10*a*, similar to the before-mentioned conventional comb 10, comprises an elongate base member 12, a number of identical tooth members 14 arranged on the base member 12 and several different tooth members, for example three members 30, 32 and 34, arranged on the base member 12 on a portion which will be referred as a downstream portion of the comb or the air passage 18 hereinafter. As shown in this drawing, the sectional areas of the openings 30*a*, 32*a* and 34*a* of the tooth members 30, 32 and 34 are gradually decreased with increase of distance from the air jet nole 22, while the sectional areas of the openings of the identical tooth members 14-1 to 14-8 remain unchanged. Furthermore, the inclination angles of the frusto-conical surfaces of the openings 30*a*, 32*a* and 34*a* with respect to the longitudinal center line of the air passage 18 are reduced with increase of distance from the air jet nole 22. Furthermore, the openings 30*a*, 32*a* and 34*a* of the respective tooth members are so sied that at the time the leading end 20*a* of the weft yarn 20 passes through each of the openings in the tooth members, the corresponding warp yarns 24*a*, 24*b* are still located above and below the periphery thereof (i.e. 30*a*, 32*a* and 34*a*). Although in this drawing, the comb 10*a* is shown to have only three different tooth members 30, 32 and 34 for facilitation of the drawing and explanation, more than three different tooth members of course may be employed in actual practice.

The air guiding comb 10*a* thus provided has revealed that the velocity of the air stream flowing through the air passage 18 is not so critically reduced and the unwanted entanglement of the weft yarn 20 with the warp yarns 24 does not occure with a result that the weft yarn insertion into the shed is optimally achieved.

In FIG. 4, the second preferred embodiment is shown as designated by numeral 10*b*. The comb 10*b* comprises an elongate base member 12 and a number of different tooth members 36 to 56 arranged on the base member 12. As shown, the sectional areas of the openings of the tooth members 36 and 56 are gradually reduced with increase of distance from the air jet nole 22. Furthermore, in this embodiment, the inclination angles of the frusto-conical surfaces of the tooth members 36 to 50 positioned on an upstream portion of the comb 10*b* with respect to the longitudinal axis of the air passage 18 are substantially identical, and the inclination angles of those of the tooth members 52 to 56 positioned on a downstream portion of the comb 10*b* are gradually reduced with increase of distance from the air jet nole 22. Although in this figure, only three tooth members 52 to 56 are shown having different inclination angles, it is to be understood that more than three tooth members are employed in practice. In comparison with the before-mentioned first embodiment 10*a*, the comb 10*b* provides a slightly greater air leakage out of the air passage. However, this leakage does not critically affect the air stream in the air passage 18. This is because the clearances defined between the neighbouring tooth members, such as 52, 54 and 56, which are located at the downstream portion of the comb 10*b*, are enclosed by the upper and lower groups 24*a* and 24*b* of the warp yarns 24 to provide a stable air stream in the air passage 18 when the leading end 20*a* of the weft yarn 20 passes through the openings of the corresponding tooth members. It should be noted that in this second embodiment, since the upper and lower groups of the warp yarns 24 can be controlled to start their inversion movements as soon as the leading end 20*a* of the weft yarns 20 is jetted from the air jet nole 22, high speed weaving is available. Several experiments have revealed that this type comb 10*b* is very suitable for an air jet loom having a relatively narrow picking width.

In FIG. 5, there is shown the third preferred embodiment of the present invention as being generally designated by numeral 10*c*. The comb 10*c* is similar to the second embodiment 10*b* and comprises an elongate base member 12 and a plurality of tooth members 14-1 to 62-2 which are arranged on the base member 12, as shown. In this embodiment, however, several pairs of tooth members, such as 14-3 and 58-1, 58-4 and 60-1 and 60-2 and 62-1, each pair having respective openings which are different in sie are located intermittently in the row of the tooth members while keeping a tendency in which the tooth member with smaller opening is located at the downstream portion of the comb 10*c*. In this figure, the tooth members (14-1, 14-2 and 14-3), (58-1, 58-2, 58-3 and 58-4), (60-1 and 60-2), and (62-1 and 62-2) have identical openings, respectively.

It should be noted that the embodiments of FIGS. 3, 4 and 5 have the following two common features. First, the clearances defined by the neighbouring tooth members which are located at the downstream portion of the comb are timingly enclosed by the upper and lower groups 24*a* and 24*b* of the warp yarns to provide a stable air stream in the air passage 18 just when the leading end 20*a* of the weft yarn 20 passes through the openings of the corresponding tooth members. Second, the inclination angles of the frusto-conical surfaces, with respect to the longitudinal axis of the air passage 18, of the tooth members which are positioned at the downstream portion of the comb are gradually or stepwisely reduced with increase of the distance from the air jet nole 22. These features ensure the proper picking of the weft yarn by the reasons mentioned before.

In FIG. 6, the fourth embodiment of the invention is shown. The comb of the embodiment is generally designated by numeral 10*d* and comprises an elongate base member 12 and a plurality of tooth members 64 to 72-7 fixed on the base member 12. In this embodiment, the sectional areas of the openings of the tooth members 64, 66, 68, 70 and 72-1 positioned at the upstream portion of the comb 10*d* are increased with increase of distance from the air jet nole 22, and simultaneously, the inclination angles of the frusto-conical surfaces of these tooth members with respect to the longitudinal axis of the air passageway 18 are stepwisely increased with increase of such distance, as shown. In this case, however, the other tooth members, such as 72–2 to 72–7, positioned at the downstream portion of the comb 10*d* have substantially identical openings. With this, the flow resistance of the air passage 18 against the passing air from the air jet nole 22 is desirably decreased thereby providing in the air passage 18 an air stream having sufficient force to carry the weft yarn 20. In this embodiment, the velocity of the jetted air from the nole 22 is not so greatly reduced regardless of the formation of the relatively large down stream portion of the air passage 18 because the air stream under diffusion is reflected by the gradually sharpened frusto-conical surfaces of the openings of the tooth members, such as 64 to 72-1, to be concentrated in the longitudinal center line of the air passage 18 to increase the weft yarn carrying ability of the air stream.

In FIG. 7, the fifth embodiment is shown as being generally designated by numeral 10*e*. The comb 10*e* of the embodiment comprises an elongate base member 12 and a plurality of tooth members 74 to 94 arranged on the base member 12. In this case, the sectional areas of the openings of the tooth members 74 to 94 are increased throughout the whole of the air guide comb with increase of distance from the air jet nole 22. Furthermore, the inclination angles of the frusto-conical surfaces of the tooth members 90, 92 and 94 with respect to the longitudinal center line of the air passage 18 are increased with increase of distance from the air jet nole 22. By this construction, the undesirable drop of the air velocity in the air passage 18 is more effectively suppressed due to the provision of the gradually enlarged openings of the tooth members. According to several experiments, it has been revealed that this type comb 10*e*, is very suitable for an air jet loom having a relatively wide picking width.

In FIG. 8, the sixth embodiment is shown as being denoted by numeral 10*f*. The comb 10*f* of the embodiment comprises an elongate base member 12 and a plurality of tooth members 96 to 116 arranged on the base member 12. In this embodiment, the tooth members are so arranged that the sectional areas of the openings of the tooth members 96 to 116 are gradually increased with increase of distance from the air jet nozzle 22, and simultaneously the inclination angles of the frusto-conical surfaces defining the openings of the tooth members 96 to 116 with respect to the longitudinal center line of the air passage 18 are gradually increased with increase of the distance.

It should be noted that the embodiments of FIGS. 6, 7 and 8 have the following two common features. First, the sectional areas of the openings of the tooth members are gradually increased, throughout the entire length or at least at the upstream portion of the comb, with increase of distance from the air jet nozzle 22. Second, the inclination angles of the frusto-conical surfaces of these tooth members with respect to the longitudinal axis of the air-passage distance. These futures ensure the proper picking of the weft yarn by the reasons mentioned before.

In FIG. 9, the seventh embodiment is illustrated as being designated by numeral 10*g*. The comb 10*g* is constructed by taking into consideration the concepts defined by the first and fourth embodiments and comprises an elongate base member 12 and a plurality of tooth members 118 to 134. As seen in this drawing, the tooth members such as 118 to 124 positioned at the upstream portion of the comb 10*g* have openings the sectional areas of which are gradually increased with increase of distance from the air jet nozzle 22 and the inclination angles of the frusto-conical surfaces of which with respect to the longitudinal center line of the air passage 18 are increased with the increase. On the contrary, the tooth members such as 130 to 134 positioned at the most downstream portion of the comb 10*g* have openings the sectional areas of which are gradually decreased with increase of distance from the air jet nozzle 22 and the inclination angles of the frust-conical surfaces of which with respect to the longitudinal center line of the air passage 18 are decreased with the increase.

What is claimed is:

1. An air guide comb for an air jet loom having an air jet nozzle through which a pressurized air is passed out with a weft yarn, and a row of aligned air guiding tooth members arranged in a manner that openings formed in the respective tooth members from an air passage through which said weft yarn is passed by the aid of said pressurized air, each of said openings being bounded by a frusto-conical surface of the corresponding tooth member with an apex of said surface pointing in the direction of weft yarn picking, which is characterized in that said row of aligned air guiding tooth members has at least first and second adjacent tooth members having respective openings which form a part of said air passage and are stepwisely different in sectional area, and the inclination angles of the frusto-conical surfaces defining the openings of said first and second tooth members, with respect to the longitudinal center line of said air passage being different from each other.

2. An air guide comb as claimed in claim 1, in which the sectional area of the opening of said first tooth member is larger than that of said second tooth member.

3. An air guide comb as claimed in claim 2, in which said second tooth member is located nearer to said air jet nozzle than said first tooth member.

4. An air guide comb as claimed in claim 3, in which said first and second tooth members are arranged at a downstream portion of said air passage formed by said aligned air guiding tooth members.

5. An air guide comb as claimed in claim 3, in which said first and second tooth members are arranged at an upstream portion of said air passage formed by said aligned air guiding tooth members.

6. An air guide comb as claimed in claim 5, further comprising third and fourth adjacent tooth members which have respective openings forming another part of said air passage and are arranged at a downstream portion of said air passage in a manner that said third tooth member is located nearer to said air jet nozzle than said fourth tooth member, the sectional area of said third tooth member being larger than that of said fourth tooth member.

7. An air guide comb as claimed in claim 6, in which the inclination angle of the frusto-conical surface of said first tooth member is greater than that of said second tooth member, and in which the inclination angle of the frusto-conical surface of said third tooth member is greater than that of said fourth tooth member.

8. An air guide comb as claimed in claim 3, in which the inclination angle of the frusto-conical surface of said first tooth member is greater than that of said second tooth member.

9. An air guide comb as claimed in claim 2, in which said first tooth member is located nearer to said air jet nozzle than said second tooth member.

10. An air guide comb as claimed in claim 9, in which said first and second tooth members are arranged at a downstream portion of said air passage formed by said aligned air guiding tooth members.

11. An air guide comb as claimed in claim 9, in which the inclination angle of the frusto-conical surface of said first tooth member is greater than that of said second tooth member.

* * * * *